US011348393B2

(12) United States Patent
Uyeda

(10) Patent No.: US 11,348,393 B2
(45) Date of Patent: May 31, 2022

(54) ELECTRONIC KEYPAD ASSEMBLY FOR LOCKSET

(71) Applicant: Spectrum Brands, Inc., Middleton, WI (US)

(72) Inventor: Alan Uyeda, Irvine, CA (US)

(73) Assignee: Spectrum Brands, Inc., Middleton, WI (US)

( * ) Notice: Subject to any disclaimer, the term of this patent is extended or adjusted under 35 U.S.C. 154(b) by 197 days.

(21) Appl. No.: 16/554,240

(22) Filed: Aug. 28, 2019

(65) Prior Publication Data

US 2020/0074776 A1 Mar. 5, 2020

Related U.S. Application Data

(60) Provisional application No. 62/724,388, filed on Aug. 29, 2018.

(51) Int. Cl.

| | |
|---|---|
| ***H01H 13/04*** | (2006.01) |
| ***G07C 9/00*** | (2020.01) |
| ***E05B 47/02*** | (2006.01) |
| ***G07C 9/33*** | (2020.01) |
| ***H01H 13/70*** | (2006.01) |
| *E05B 47/00* | (2006.01) |

(52) U.S. Cl.

CPC ..... *G07C 9/00944* (2013.01); *E05B 47/02* (2013.01); *G07C 9/00674* (2013.01); *G07C 9/00817* (2013.01); *G07C 9/33* (2020.01); *H01H 13/04* (2013.01); *H01H 13/70* (2013.01); *E05B 2047/0013* (2013.01); *G07C 2009/00222* (2013.01)

(58) Field of Classification Search

CPC ..... H01H 13/04; H01H 13/70; H01H 13/14; H01H 9/02; H01H 13/86; H01H 2223/00; H01H 13/063; H01H 19/04; H01H 2009/0278; H01H 21/04; G07C 9/00944; G07C 9/33; G07C 9/00674; G07C 9/00817; G07C 2009/00222; E05B 47/02; E05B 2047/0013; E05B 2047/0058; E05B 2047/0048

See application file for complete search history.

(56) References Cited

U.S. PATENT DOCUMENTS 5,845,523 A * 12/1998 Butterweck ..... E05B 47/0673 70/278.1
2002/0056300 A1* 5/2002 Pierre ..... E05B 47/0688 70/303 A
2018/0171672 A1* 6/2018 Lin ..... E05B 47/06

FOREIGN PATENT DOCUMENTS

CA 2 373 022 A1 11/2000
CN 201554281 U 8/2010

(Continued)

OTHER PUBLICATIONS

International Search Report and Written Opinion for Application No. PCT/US2019/048593 dated Nov. 5, 2019.

*Primary Examiner* — Ahmed M Saeed
(74) *Attorney, Agent, or Firm* — Merchant & Gould P.C.

(57) ABSTRACT

An electronic security keypad assembly includes a cover made of sheet metal, a keypad, and a mounting plate. Tabs extending the from the cover engage dented tab receiving regions of the mounting plate to secure the cover to the mounting plate. The tabs, when bent around the dented tab receiving regions, are obscured from access when mounted to a door, deterring physical tampering with the electronic keypad assembly.

18 Claims, 15 Drawing Sheets

(56) References Cited

FOREIGN PATENT DOCUMENTS

| | | | |
|---|---|---|---|
| KR | 10-0695883 | B1 | 3/2007 |
| KR | 20-2009-005990 | U | 6/2009 |
| KR | 10-2016-0057171 | A | 5/2016 |

* cited by examiner

ELECTRONIC KEYPAD ASSEMBLY FOR LOCKSET

CROSS-REFERENCE TO RELATED APPLICATION

This application claims the benefit of U.S. Provisional Patent Application Ser. No. 62/724,388, filed Aug. 29, 2018, which application is hereby incorporated by reference in its entirety.

BACKGROUND

Electronic locks have gained increasing acceptance and widespread use in residential and commercial markets. These locksets control ingress through doors in a building by requiring certain credentials. For example, these locksets typically include a control circuit that determines whether to unlock the lockset based on credentials provided by the user. In some cases, the credentials and/or commands may be provided to the lockset via a keypad.

Structures for deadbolts must have certain specifications in order to meet security requirements. For example, there are standardized requirements for durability of an assembly used for actuating a deadbolt, to avoid the possibility of compromising the deadbolt by damaging the associated assembly. In the case of electronic keypads, this typically means that a keypad housing is made from a highly impact-resistant material, such as a cast metal. However, using such materials can be expensive from a manufacturing perspective, and have increased cost to consumers. Accordingly, improvements in electronic lock design are desired.

SUMMARY

The present disclosure relates generally to electronic locks. In one possible configuration, and by non-limiting example, an electronic security keypad is provided that can be used in conjunction with an electronic lock assembly to secure a door.

In one aspect, an electronic security keypad assembly includes at least a cover, a keypad, and a mounting plate. The cover has a front surface portion with a plurality of openings. The cover also has at least two side surface portions and a plurality of fasteners. The keypad includes a plurality of keypad buttons that are configured to be exposed through the plurality of openings in the cover. The keypad buttons are configured to convert physical input into electrical signals. The mounting plate includes a plurality of fastener receiving regions configured to receive the plurality of fasteners. Mating the fasteners to the fastener receiving regions secures the keypad between the cover and the mounting plate.

In a second aspect, a method of manufacturing an electronic security keypad assembly includes forming a cover from sheet metal, the cover having a front surface portion having a plurality of openings, at least two side surface portions, and a plurality of tabs extending from the side surface portions; positioning a keypad between the cover and a mounting plate in alignment with the cover to allow a plurality of keypad buttons of the keypad to be exposed through the plurality of openings; and bending each of the plurality of tabs into tab receiving regions of the back plate until each of the plurality of tabs is positioned in alignment with a rearward surface of the backplate.

In a third aspect, an electronic security keypad assembly mountable to a door includes a cover comprising a front surface portion having a plurality of openings, at least two side surface portions, and a plurality of tabs extending from the at least two side surface portions, and a keypad including a plurality of keypad buttons that are configured to be exposed through the plurality of openings in the cover, the plurality of keypad buttons being configured to convert physical input into electrical signals, the keypad further including a printed circuit board assembly and a cable extending therefrom. The electronic security keypad assembly further includes a mounting plate comprising a plurality of dented tab receiving regions that receive the plurality of tabs such that each of the plurality of tabs is bent into a position in alignment with a rearward surface of the backplate. When the electronic security keypad assembly is installed on a door, the tabs are positioned between a surface of the door and the mounting plate.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
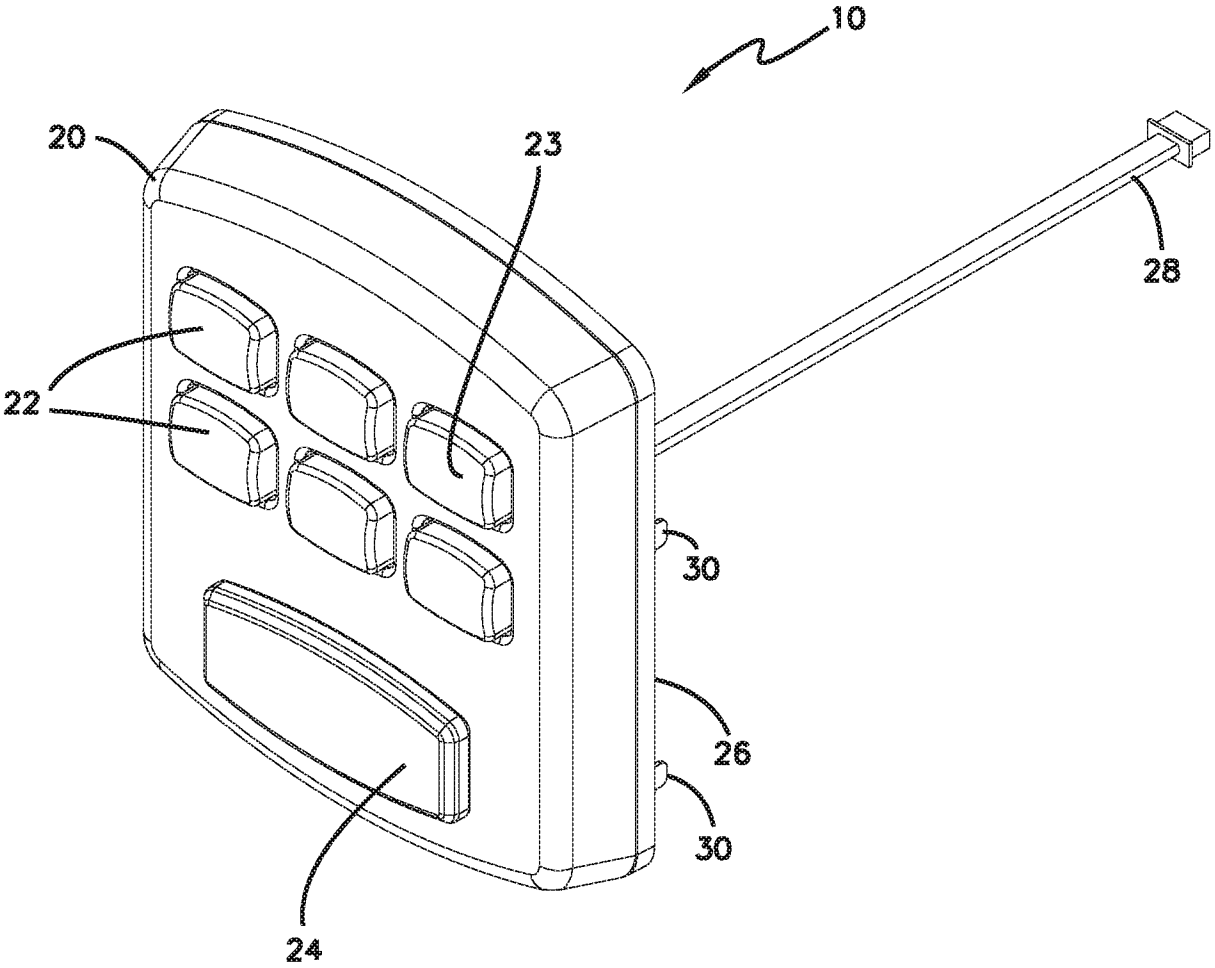
FIG. 1 illustrates a front perspective view of an example electronic keypad assembly.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

According to example embodiments, an electronic security keypad assembly is disclosed that provides for secure electronic access at an electronic lock assembly, while being less expensive to manufacture than existing keypads. For example, use of sheet metal to form the decorative cover (rose) is less expensive than die cast zinc, which is used in most other lock assemblies. Fasteners on the sheet metal cover fasten to a mounting plate to secure the assembly against tampering. The fasteners can be tabs, snaps, or threaded holes. Additionally, a spacer insert within the assembly maintains positioning of a keypad membrane relative to the sheet metal cover. A mounting plate is formed with fastener receiving portions that maintain the cover in place, while being obscured from access when mounted, thereby deterring physical tampering with the electronic security keypad assembly. Further, the fasteners mate the cover to the mounting plate with a strength lower than the impact force created during vertical impact testing specified by BHMA A156.36 Section 12, such that the cover will be separated from the mounting plate while the mounting plate remains intact. This allows the mounting plate to remain in place on the door or other surface to which it is installed, preventing access through any holes in such a surface. Still further, in some embodiments, the electronic security keypad assembly is, when in an assembled state, substantially weatherproof.

This disclosure generally relates to an electronic lock assembly with certain features, and in particular, to a specific electronic keypad assembly useable within such an electronic lock assembly. The term "electronic lock" or "electronic lock assembly" is broadly intended to include any type of lockset that uses electrical power in some manner, including but not limited to, electronic deadbolts, electronic lever sets, etc. This disclosure encompasses the integration of one or more features described herein into any type of electronic lock and is not intended to be limited to any particular type of electronic lock. The term "electronic security keypad assembly" generally includes at least a portion of an electronic lock assembly that includes a keypad for electromechanically locking or unlocking the lock assembly, or actuating such a lock assembly. This can be in response to, for example, entry of a predetermined code that is programmed into the electronic lock assembly.

The electronic security keypad assembly can be installed on a door in electric communication with a deadbolt or other electronic locking mechanism. The keypad receives physical input of a numerical or alphabetical code. Input of the correct code communicates a signal to the electromechanical locking mechanism to open (or unlock) the door.

FIGS. 1-10 illustrate various views of an electronic keypad assembly 10. As seen generally in FIGS. 1-2, an electronic keypad assembly 10 includes a cover 20 (rose). In the embodiment shown, the cover 20 is made of sheet metal that is cut and formed into a decorative cover for the keypad assembly. Sheet metal is bent to form a front surface portion 52 that is substantially flat and at least two side surface portions 54 that are at nonlinear angles with the front surface portion 52. Openings are cut in the sheet metal to allow a keypad switch membrane 22 to be exposed, allowing a user to press one or more keypad buttons 23. In the example shown, portions of the keypad switch membrane 22 protrude through openings in the cover 20. Accordingly, individual keypad buttons 23 of the keypad switch membrane 22 can be accessed through the openings. The keypad buttons 23 are configured to convert physical input into electrical signals.

In the example shown, a battery terminal cover 24 covers another opening in the cover 20. As discussed further below, the battery terminal cover 24 covers a set of battery terminals that provide an electrical connection to an external power source (e.g., an external battery, such as a 9V battery having spaced apart positive and negative terminals) to power the electronic keypad assembly when power is otherwise not available (e.g., when the electronic lock assembly to which it is connected loses power due to a dead battery or loss of electrical connection). The pair of 9 volt battery terminals 46 are positioned within the keypad such that a portion of the 9 volt battery terminals 46 protrude through one of the plurality of openings in the cover 20.

The cover 20 is attached to a mounting plate 26 with fasteners, shown as a plurality of tabs 30. An electrical cable 28 is shown extending to the rear of the electronic keypad assembly 10. In some aspects, this electrical cable 28 can be attached to an electronic lock mechanism such as a deadbolt. The electrical cable 28 can operate to transmit signals from the keypad to the electronic lock mechanism, e.g., in response to a user pressing one or more of the keypad buttons 23 on the keypad switch membrane 22. The electrical cable 28 can also provide a source of power to the keypad assembly 10 from a power source housed within the electronic lock mechanism.

Figure 3:
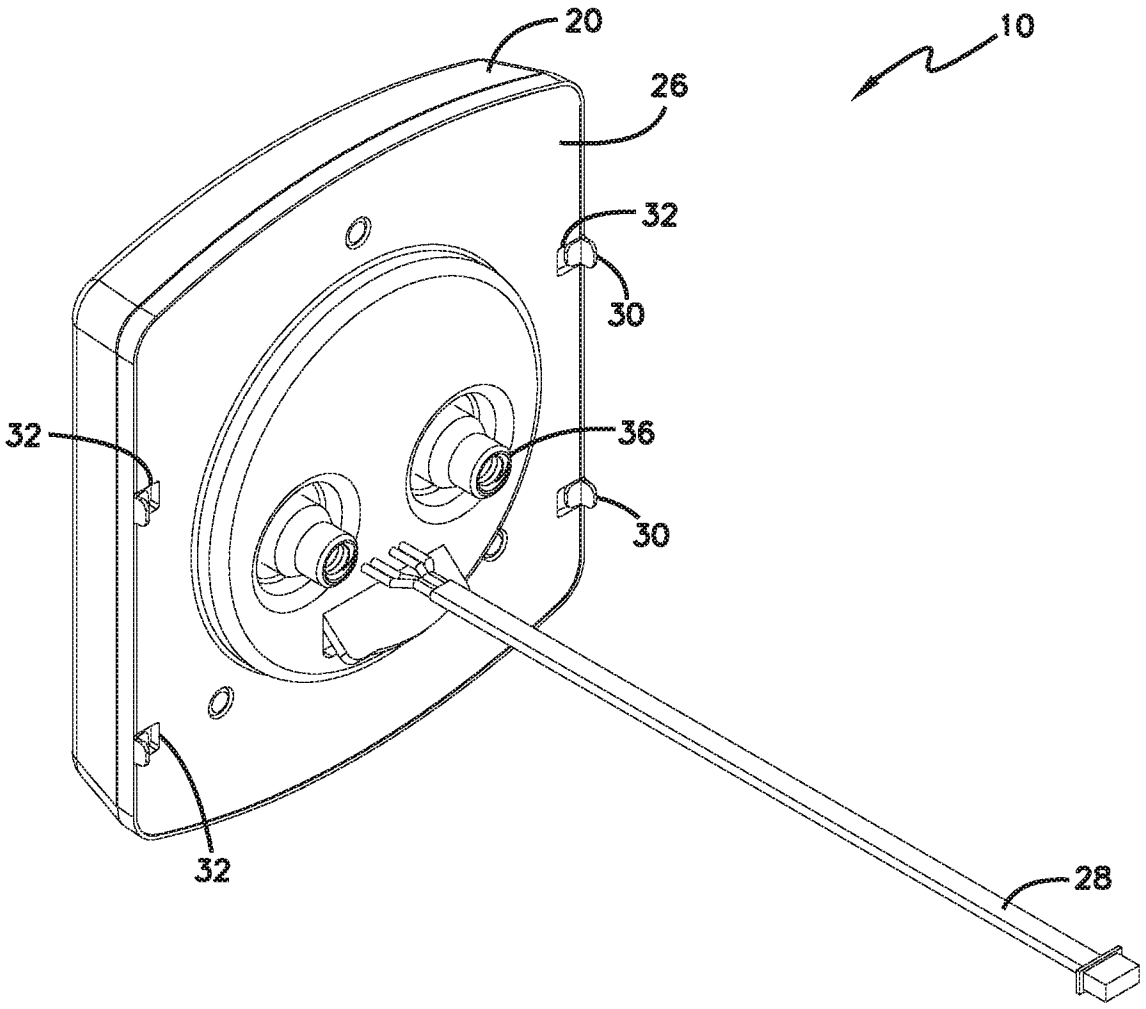
FIG. 3 illustrates a top rear perspective view of the electronic security keypad assembly of FIG. 1.
Figure 4:
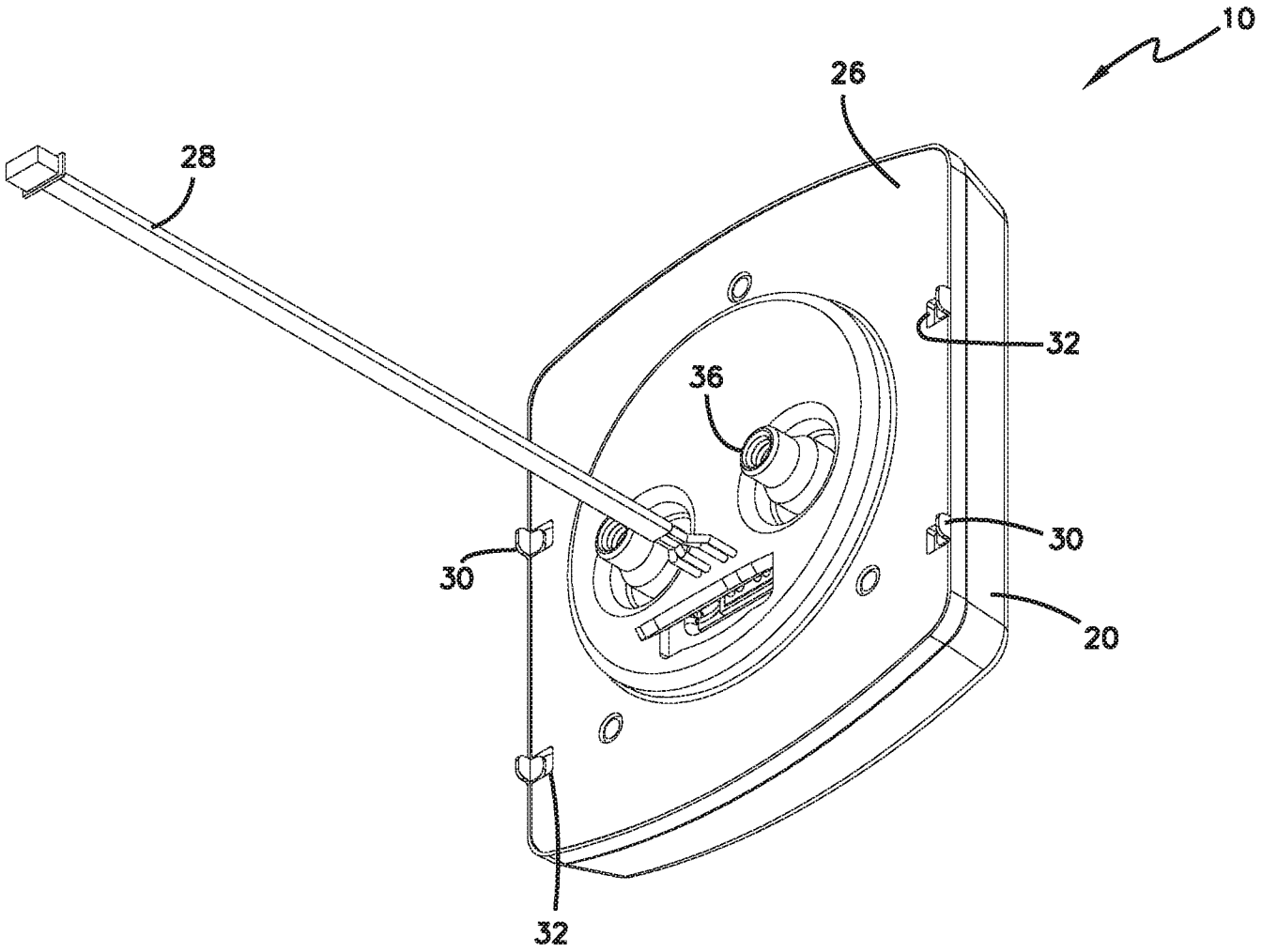
FIG. 4 illustrates a bottom rear perspective view of the electronic security keypad assembly of FIG. 1.

As seen in FIGS. 3-4, the electronic security keypad assembly 10 includes a mounting plate 26 to which the cover 20 is mounted. In the embodiment shown, tabs 30 extend from a rearward-most portion of the side surface portions 54 of the cover 20, and are bendable during a manufacturing process of the electronic keypad assembly 10. In the example shown, the tabs 30 of the cover 20 are shown folding over dented tab receiving regions 32 of the mounting plate 26, which are discussed further below in connection with FIGS. 15-16. The tabs 30, when bent to reside within the dented tab receiving regions 32, secure the cover 20 and internal components (discussed below) to the mounting plate 26. Mounting studs 36 are shown protruding from the rear of the electronic security keypad assembly 10. The mounting studs 36 have female threads on the interior which receive male threads from screws that are used to install the keypad to a door (not shown). Accordingly, when installed, the tabs 30 will preferably reside approximately flush with a mounting surface of a door or wall to which the keypad is mounted, preventing a user from prying the tabs away from the dented tab receiving regions 32 to remove the cover 20.

Figure 5:
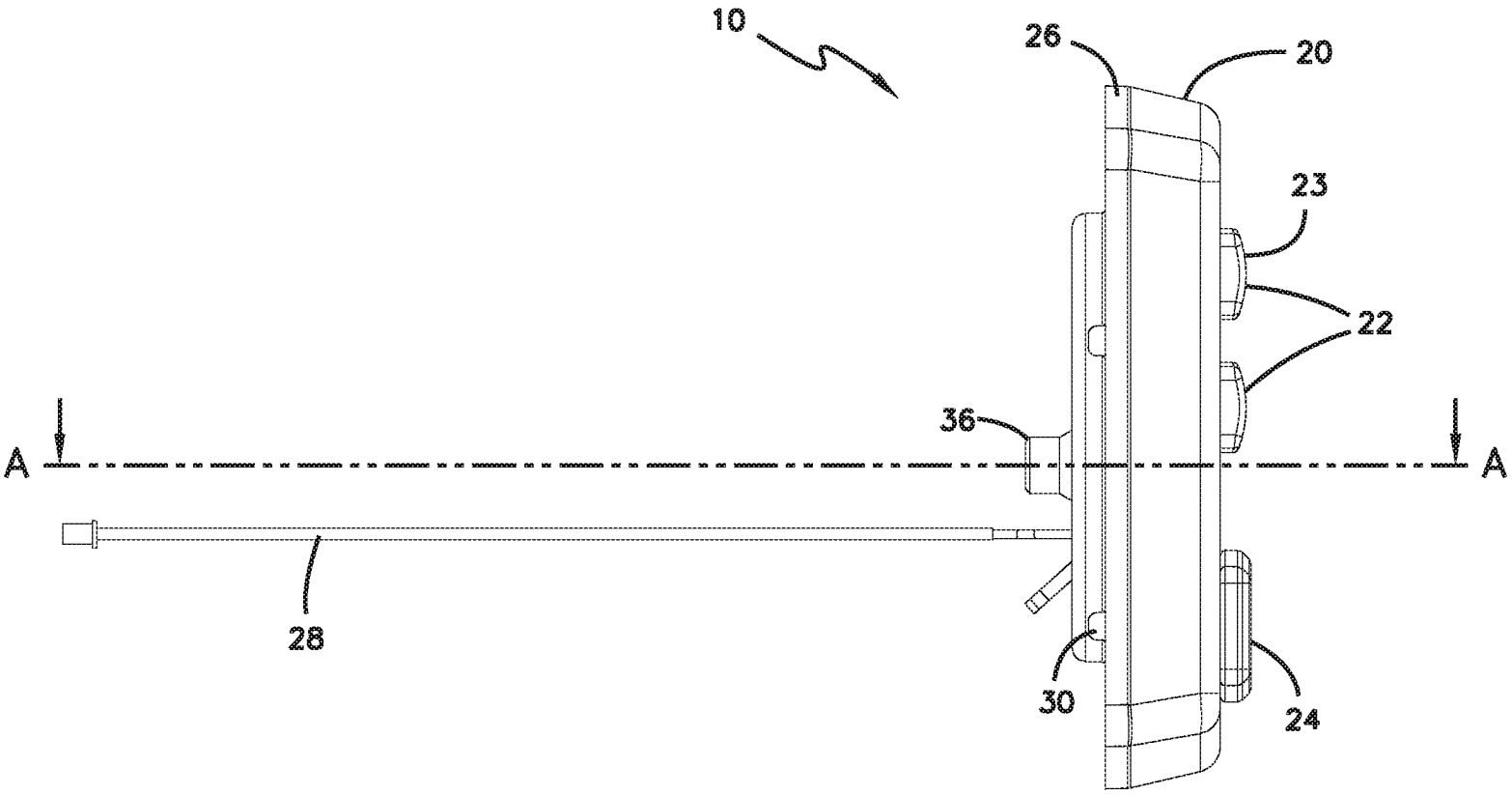
FIG. 5 illustrates a side view of the electronic security keypad assembly of FIG. 1.
Figure 6:
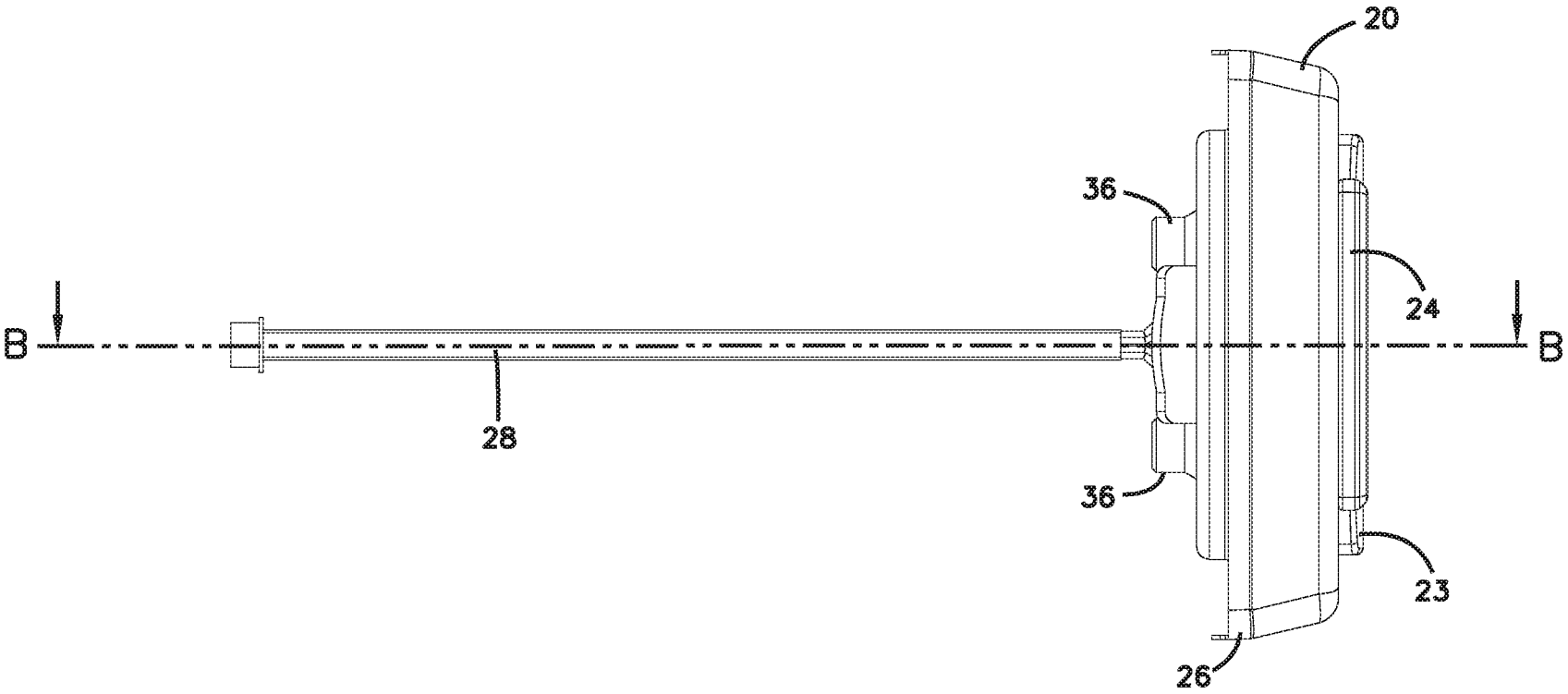
FIG. 6 illustrates a bottom view of the electronic security keypad assembly of FIG. 1.

FIG. 5 illustrates a side view of the electronic keypad assembly 10 including cross-section reference line A. FIG. 6 illustrates a bottom view of the electronic keypad assembly 10 including cross-section reference line B. The curved shape of side surface portions 54 of the cover 20 are clearly visible as well as the protruding keypad buttons 23 of the keypad switch membrane 22. The tabs 30 are shown in an extended position.

Figure 7:
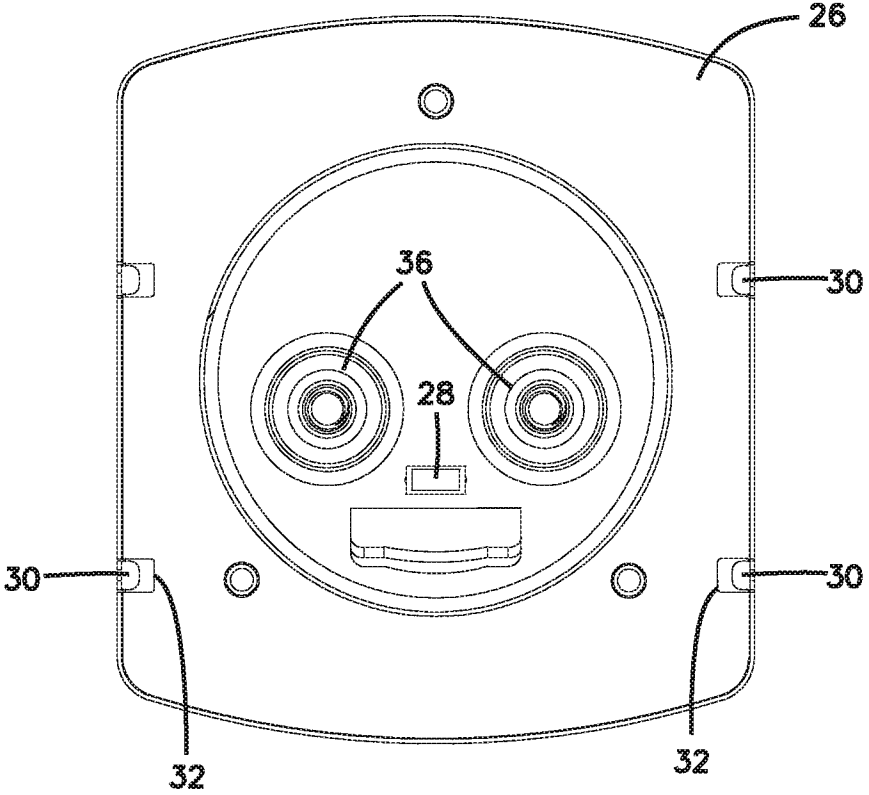
FIG. 7 illustrates a rear view of the electronic security keypad assembly of FIG. 1.

FIG. 7 illustrates a rear view of the electronic keypad assembly of FIG. 1. The tabs 30 are shown folded over the dented tab receiving regions 32, securing the mounting plate 26 in place. Also visible are the electrical cable 28 and mounting studs 36.

Figure 2:
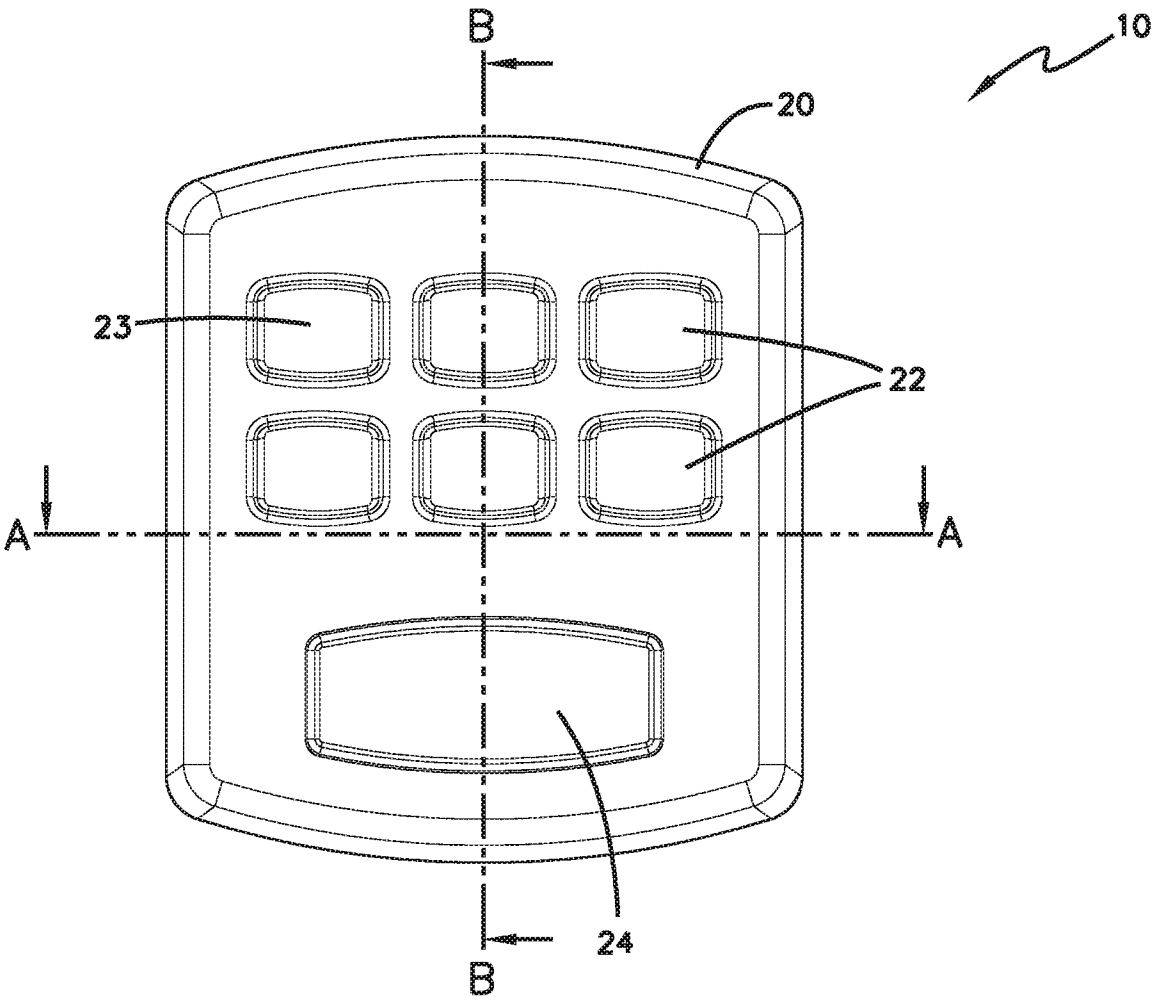
FIG. 2 illustrates a front view of the electronic security keypad assembly of FIG. 1.
Figure 8:
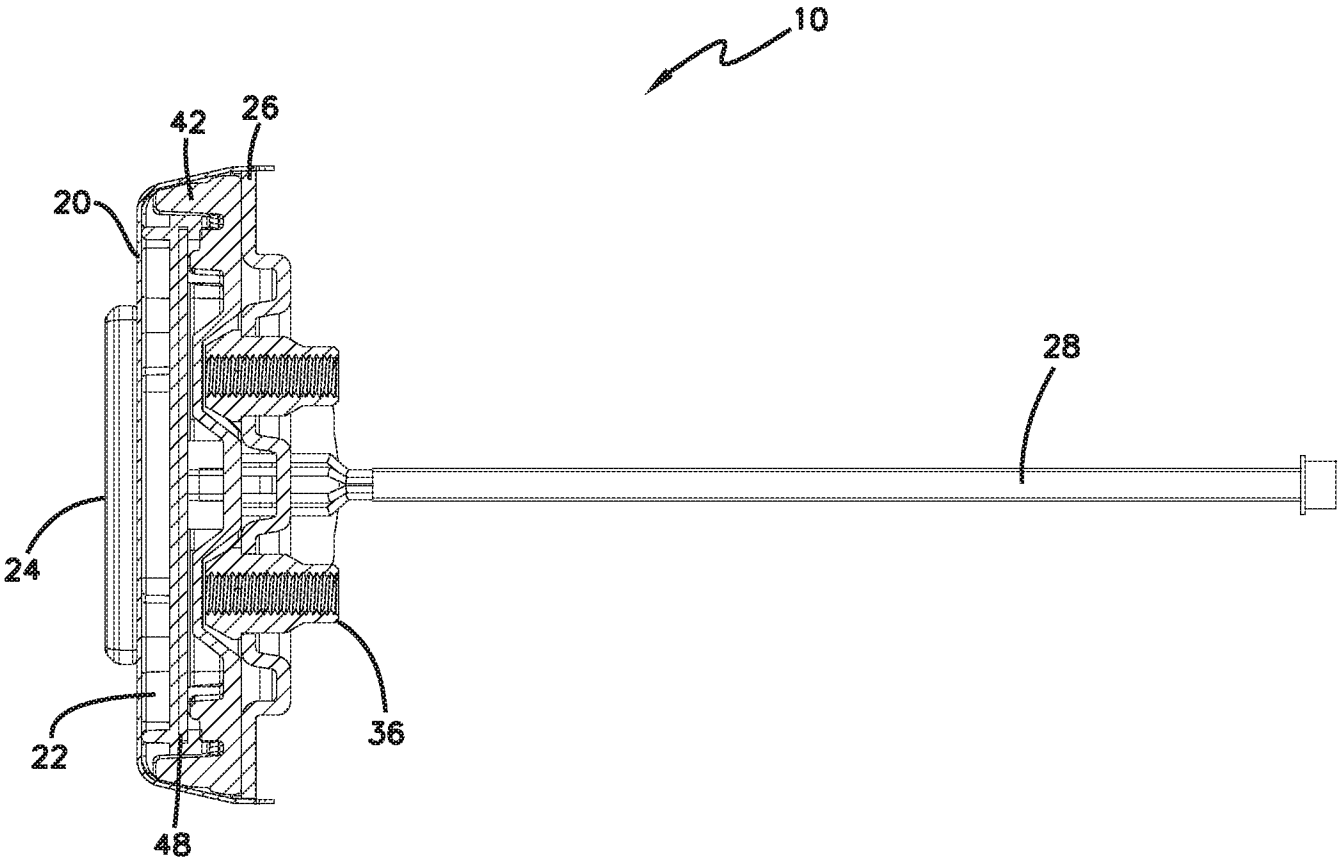
FIG. 8 illustrates a cross-sectional view of the electronic security keypad assembly of FIG. 1 along axis A as shown in FIGS. 2 and 5.
Figure 9:
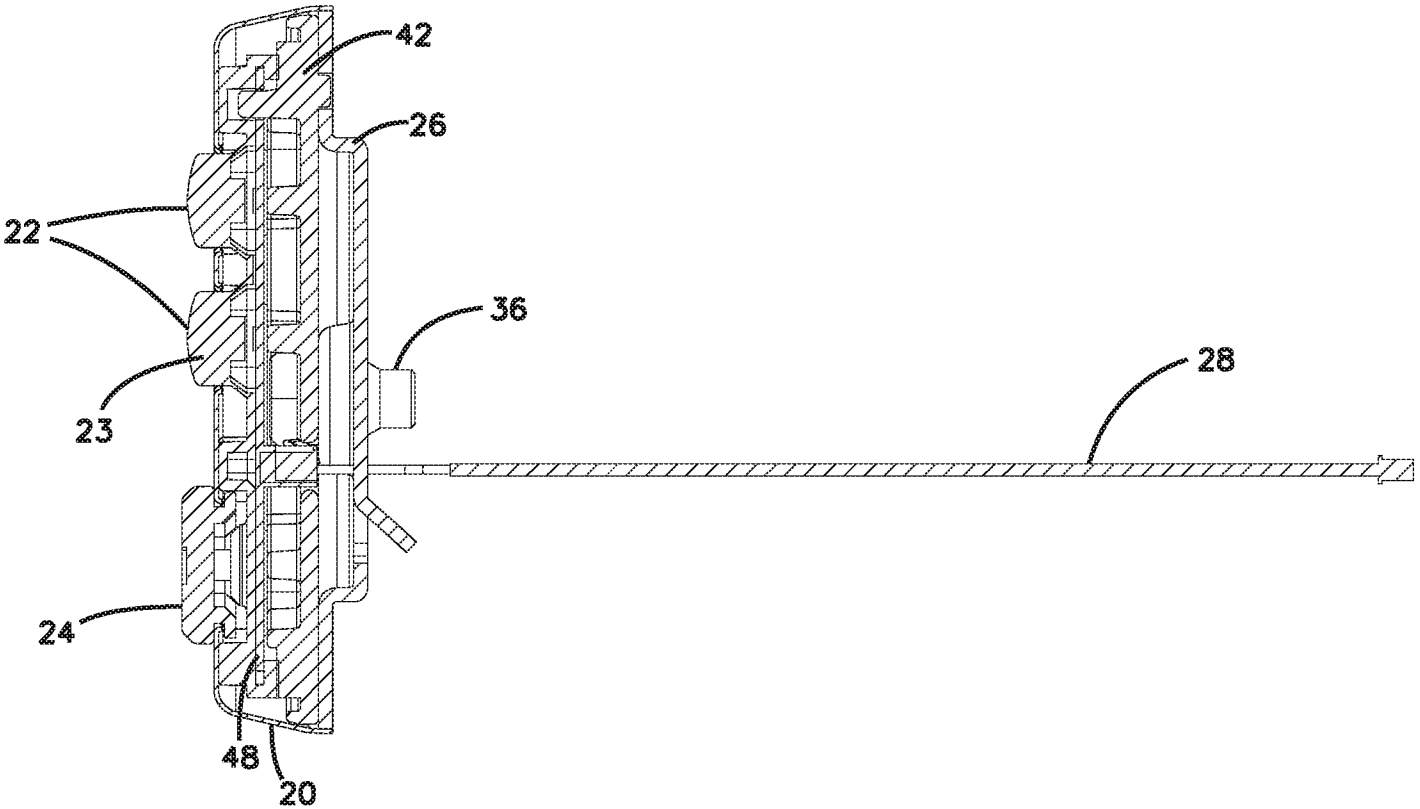
FIG. 9 illustrates a cross-sectional view of the electronic keypad assembly of FIG. 1 along axis B as shown in FIGS. 2 and 6.

FIG. 8 illustrates a cross-sectional view of the electronic keypad assembly 10 along axis A, as seen in FIGS. 2 and 5. FIG. 9 illustrates a cross-sectional view of the electronic keypad assembly 10 along axis B, as seen in FIGS. 2 and 6. In FIG. 8, the female threads of the mounting studs 36 are visible. The cover 20 is shown extending over and around the other parts of the electronic security keypad assembly 10 in a thin layer. A printed circuit board assembly (PCBA) 48, spacer plate 42, and keypad switch membrane 22 are shown between the cover 20 and the mounting plate 26. In FIG. 9, individual keypad buttons 23 of the keypad switch membrane 22 and the terminal cover 24 can be seen protruding out from the cover 20. The electrical cable 28 is shown extending to the rear of the electronic security keypad assembly 10. The keypad switch membrane 22, PCBA 48, and electrical cable 28 make up the keypad.

Figure 10:
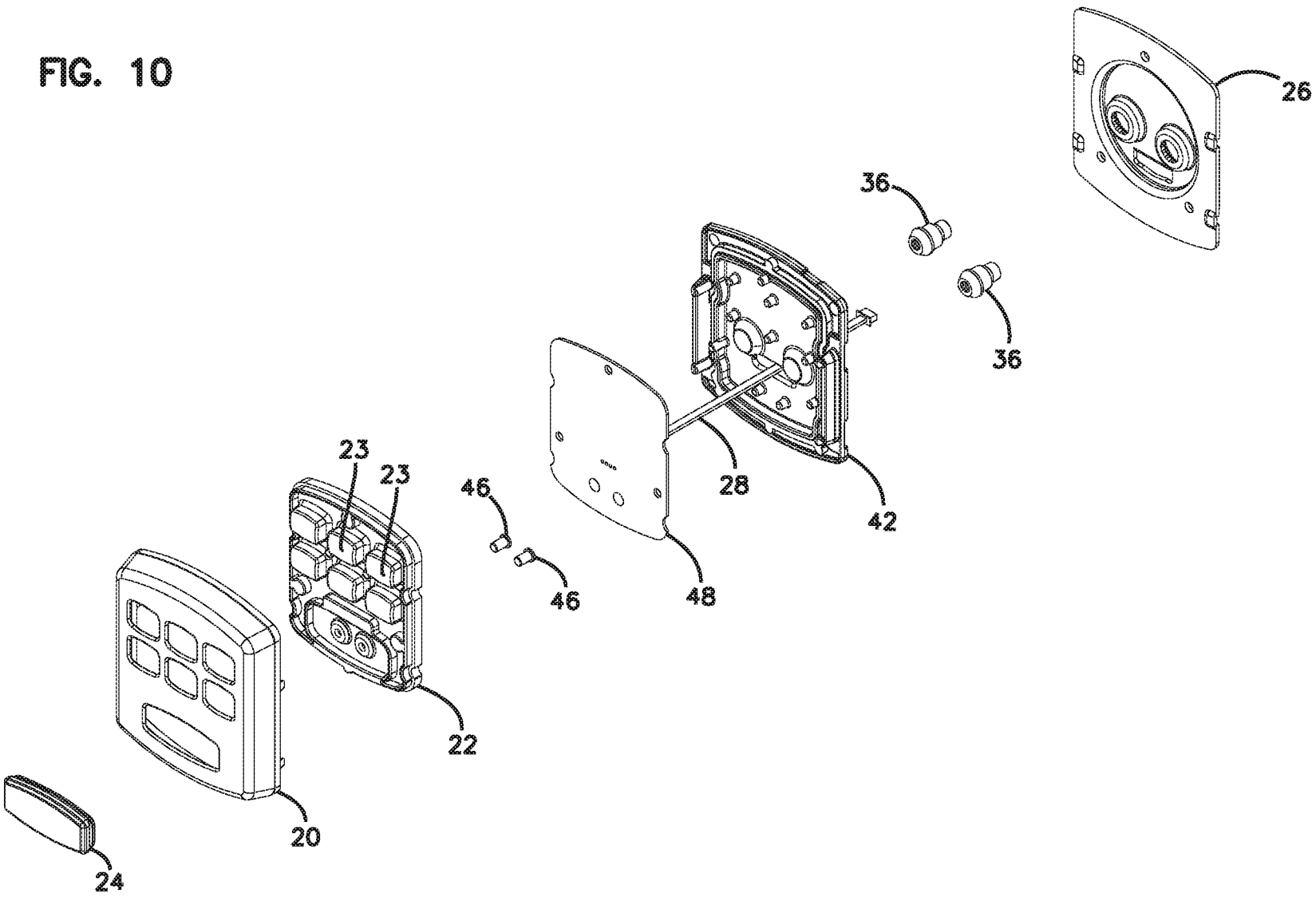
FIG. 10 is an exploded view of the electronic keypad assembly of FIG. 1.

FIG. 10 is an exploded view of the electronic keypad assembly 10 of FIG. 1. From left to right are shown the battery terminal cover 24, decorative cover 20, keypad switch membrane 22, 9 volt terminals 46, PCBA 48, spacer plate 42, mounting studs 36, and mounting plate 26.

Figure 12:
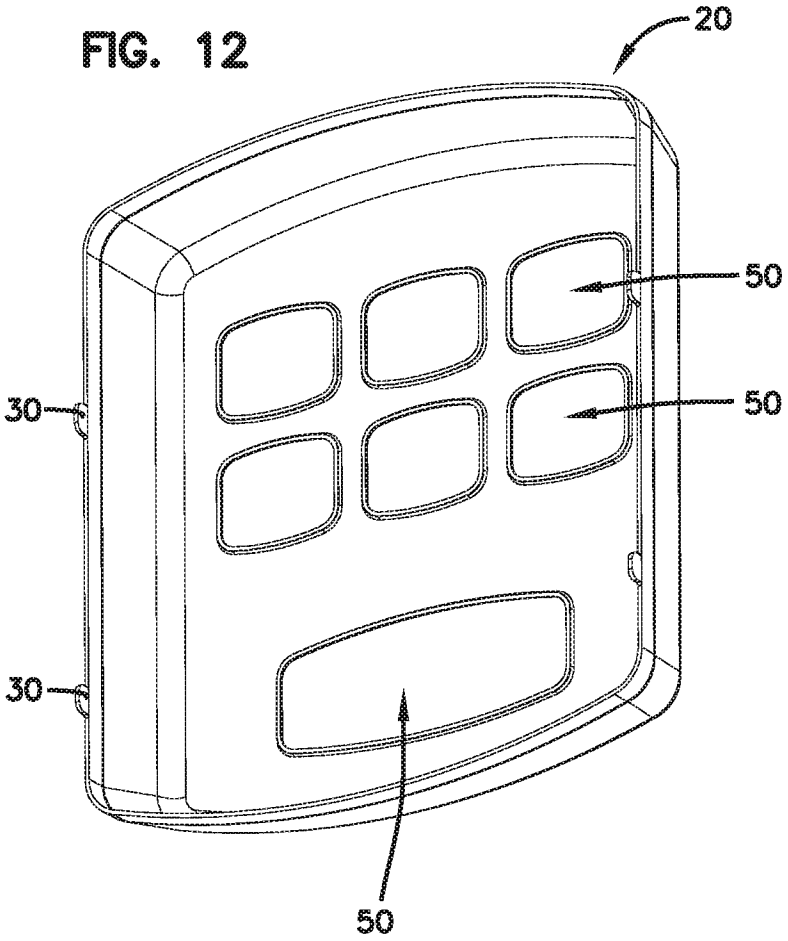
FIG. 12 illustrates a rear perspective view of the decorative cover of FIG. 11.
Figure 11:
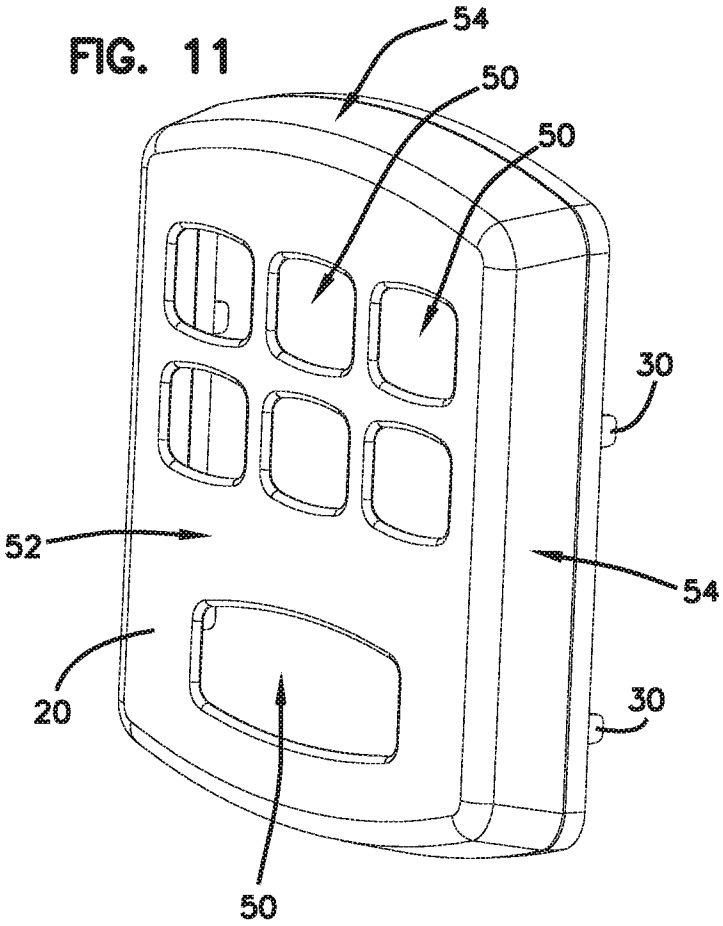
FIG. 11 illustrates a front perspective view of an example decorative cover.

Referring now to FIGS. 11-16, specific details regarding components of the electronic keypad assembly 10 are shown. FIG. 11 illustrates a front perspective view of an example cover 20 of the electronic keypad assembly 10, while FIG. 12 illustrates a rear perspective view of the cover 20. As seen in FIGS. 11-12, the cover 20 is formed from a single layer of sheet metal. In some embodiments, the sheet metal is made of steel. In other embodiments, the sheet metal is formed into thin, flat sheets from metals such as aluminum, brass, copper, tin, nickel, or titanium. The cover 20 includes a plurality of openings 50. The openings 50 provide space for keypad switches or terminal covers to protrude through. The openings 50 are cut through the front surface portion 52 of the cover 20.

In some embodiments, the front surface portion 52 is flat. In other embodiments, the front surface portion 52 is bent to form a curved surface. The cover 20 also includes at least two side surface portions 54. In the example shown in FIGS. 11 and 12, there are four side surface portions 54. The side surface portions 54 are at non-linear angles with the front surface portion 52. The side surface portions 54 are formed from bending the sheet metal. In some embodiments, the side surface portions 54 have a curved surface. The side surface portions 54 can be further bent to form decorative ridges.

As discussed above, the cover 20 has tabs 30 that are integrally formed in the sheet metal. Other fasteners can be used such as snaps or threaded holes. When initially manufactured, the tabs 30 extend rearward from the side surface portions 54. The tabs 30 can be bent inwardly by mechanical pressing means to a position approximately perpendicular with the side surface portions 54 to a position approximately parallel with the front surface portion 52 of the cover, to reside within raised tab receiving regions 32 of the mounting plate 26.

Figure 14:
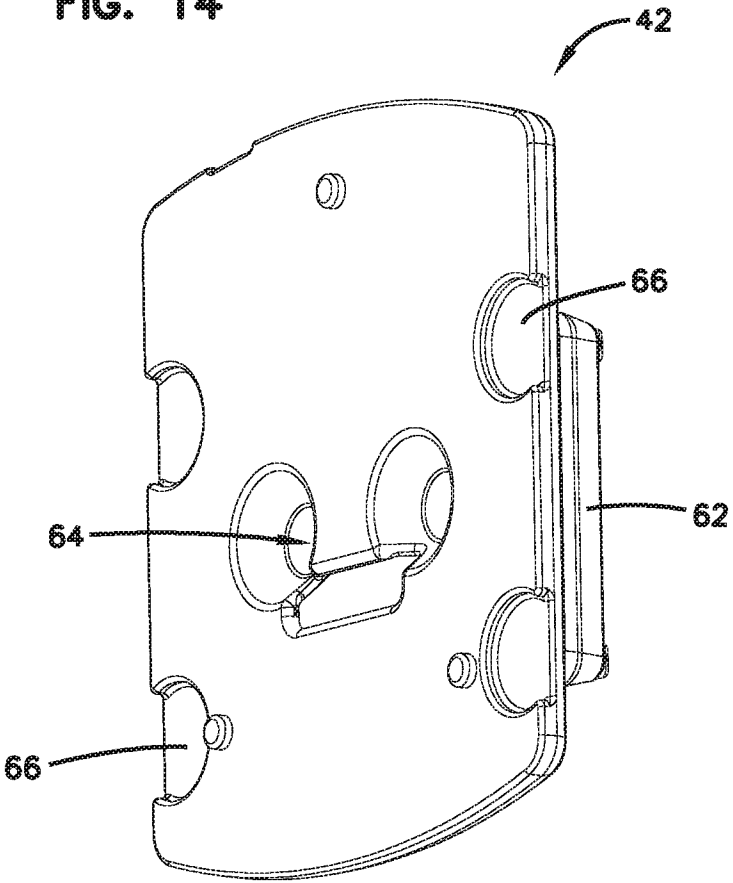
FIG. 14 illustrates a rear perspective view of the spacer of FIG. 13.
Figure 13:
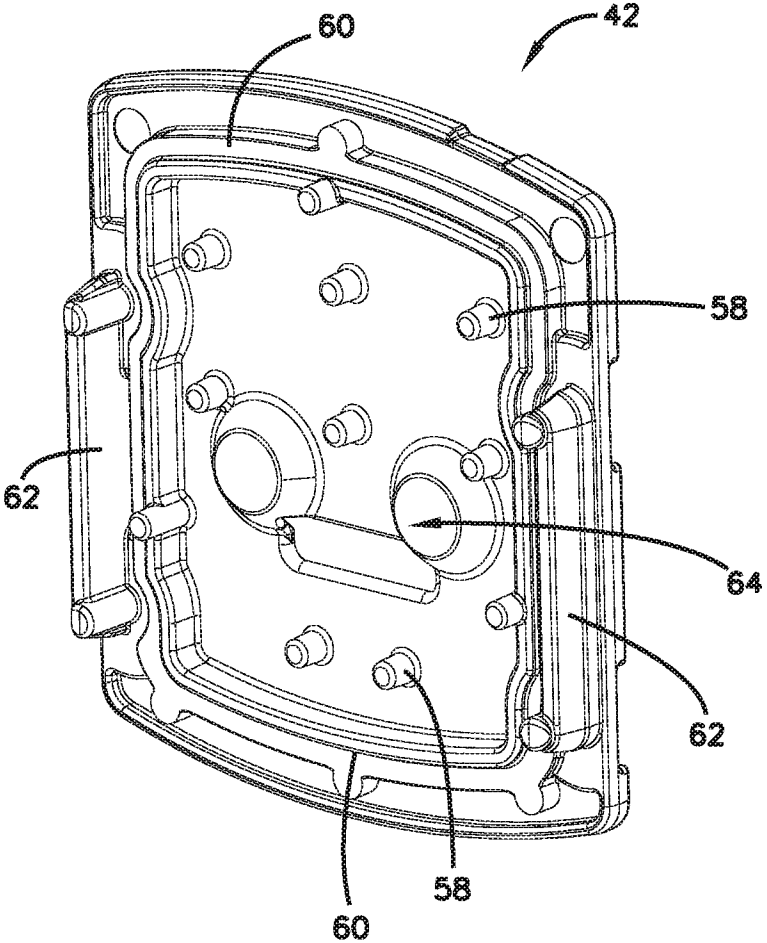
FIG. 13 illustrates a front perspective view of an example spacer.

FIG. 13 illustrates a front perspective view of an example spacer plate 42 of the electronic keypad assembly 10, and FIG. 14 illustrates a rear perspective view of the spacer plate 42. The spacer plate 42 provides support for the keypad switch membrane 22 and PCBA 48. The spacer plate 42 includes a plurality of protrusions 58, ridges 60, and supports 62 which function to fill the space between the keypad and the mounting plate 26, providing support to the keypad. The spacer plate 42 can be formed of plastic. For example, the spacer plate 42 can be formed of acrylonitrile butadiene styrene (ABS). Other suitable plastics include thermoplastics such as polymethyl methacrylate (PMMA), polylactic acid, polybenzimidazole (PBI), polycarbonate, nylon, polyether sulfone (PES), polyexymethylene (POM), polyetherether ketone (PEEK), polyetherimide (PEI), and polyethylene (PE).

Figure 16:
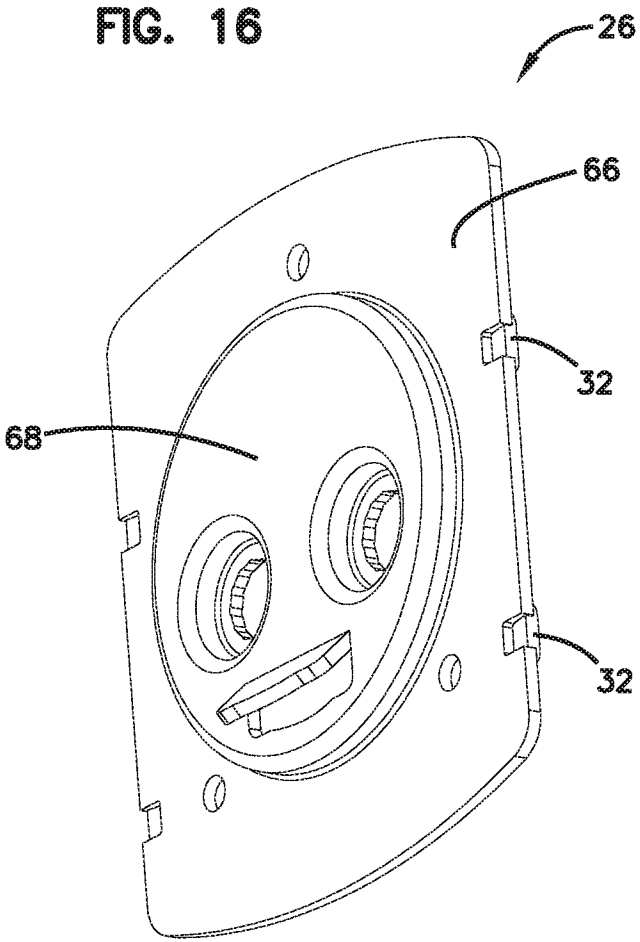
FIG. 16 illustrates a rear perspective view of the mounting plate of FIG. 15.
Figure 15:
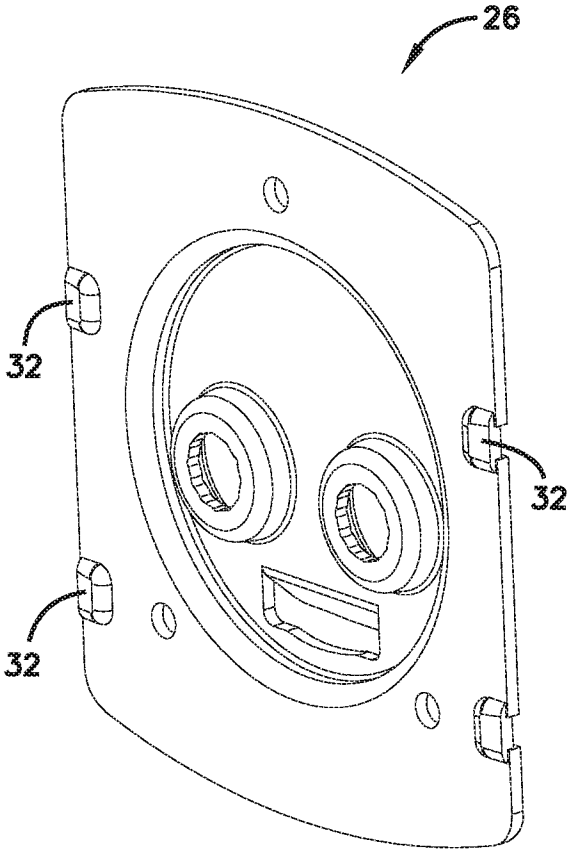
FIG. 15 illustrates a front perspective view of an example mounting plate.

FIG. 15 illustrates a front perspective view of an example mounting plate 26 of the electronic keypad assembly 10, and FIG. 16 illustrates a rear perspective view of the mounting plate 26. The mounting plate 26 comprises a plurality of dented tab receiving regions 32 configured to receive the plurality of tabs 30 wherein the folding of the tabs over the dented tab receiving regions 32 secures the keypad between the cover 20 and the mounting plate 26. Other fastener receiving regions can be used when other fasteners are included on the cover. The mounting plate 26 is preferably made of steel. The dented tab receiving regions 32 are positioned in complementary positions to the tabs 30 of the cover 20, and protrude toward the front of the mounting plate 26. Specifically, the dented tab receiving regions 32 form a space "behind" a primary surface 66 of the mounting plate 26 into which the tabs reside when bent; in such a configuration, the cover 20 is retained on the mounting plate 26, and will neither slide along nor be removable from the mounting plate by conventional means. The dented tab receiving regions 32 are configured to hold bent tabs 30 from the cover 20 in place securely.

When the electronic security keypad assembly 10 is mounted to a mounting surface of a door, in some example embodiments, the electronic keypad assembly 10 can be mounted at a bore location in the door where a deadbolt may reside. Accordingly, a circular bore receiving region 68 can reside at least partially within the bore, with mounting studs 36 retaining the keypad assembly by affixing to locations within the bore.

Additionally, screw holes 64 in the primary surface 66 of the mounting plate can optionally also retain the electronic security keypad assembly 10 in a mounted position. When mounted, preferably, the primary surface 66 will reside approximately flush with a mounting surface of a door or wall. In other embodiments, the primary surface 66 will be spaced apart from the mounting surface of the door or wall, preferably a distance less than a height of the tabs 30. Accordingly, preferably when mounted, the tabs 30 should not be bendable from the position within the dented tab receiving regions 32 to an extended position to allow the cover 20 to be removed. When the tabs 30 are in a folded position and residing within the dented tab receiving regions 32 of the mounting plate 26, the tabs 30 are positioned in alignment with the primary surface 66 of the mounting plate 26.

Figure 17:
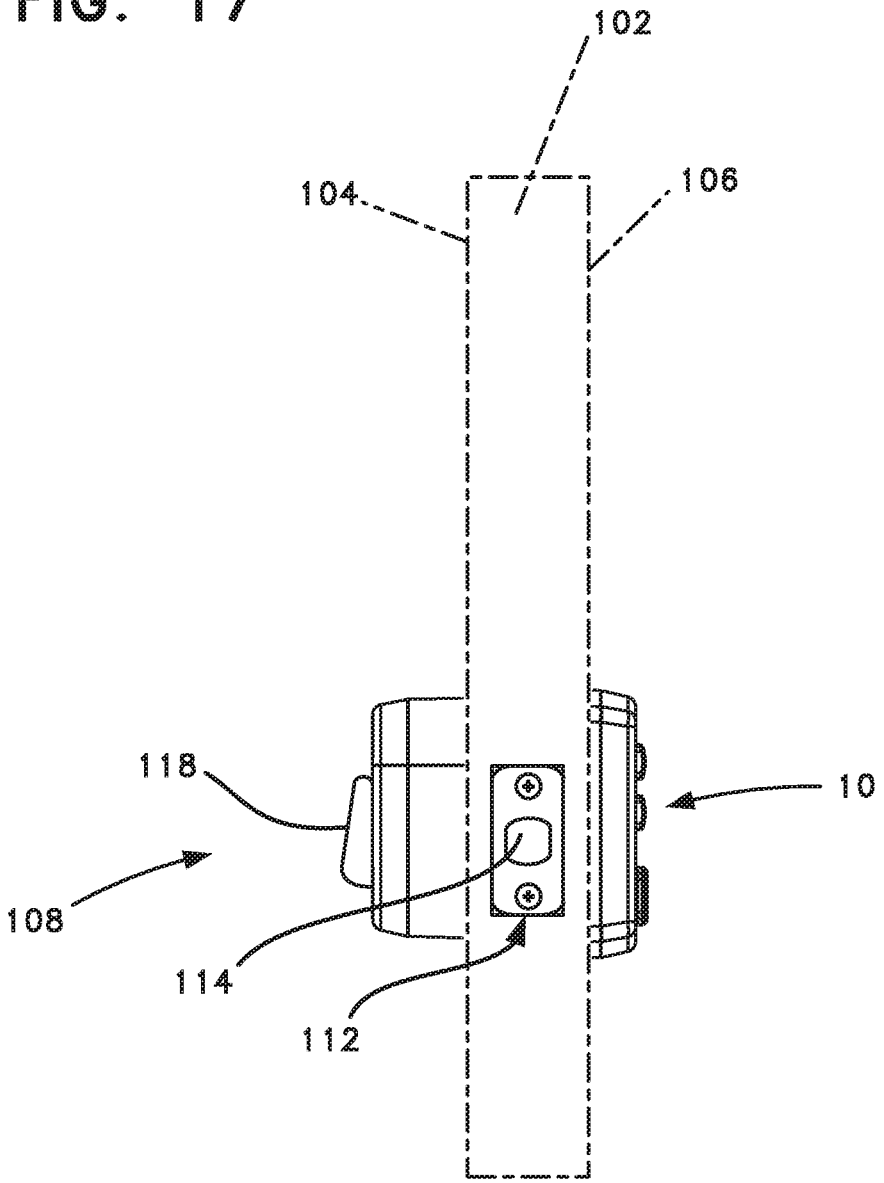
FIG. 17 illustrates a side view of an electronic lock assembly including the electronic keypad assembly of FIG. 1.

FIG. 17 illustrates an electronic security keypad assembly 10 mounted to a door 102, according to one example of the present disclosure. The door 102 has an interior side 104 and an exterior side 106. In some examples, the interior assembly 108 is mounted to the interior side 104 of the door 102, and the electronic security keypad assembly 10 is mounted to the exterior side 106 of the door 102. A latch assembly 112 is typically at least partially mounted in a bore formed in the door 102. The term "outside" is broadly used to mean an area outside the door 102 and "inside" is broadly used to denote an area inside the door 102. With an exterior entry door, for example, the electronic security keypad assembly 10 may be mounted outside a building, while the interior assembly 108 may be mounted inside a building. With an interior door, the electronic security keypad assembly 10 may be mounted inside a building, but outside a room secured by door 102, and the interior assembly 108 may be mounted inside the secured room. The electronic security keypad assembly 10 is applicable to both interior and exterior doors.

The latch assembly 112 is shown to include a bolt 114 that is movable between an extended position (locked) and a retracted position. Specifically, the bolt 114 is configured to slide longitudinally and, when the bolt 114 is retracted, the door 102 is in an unlocked state. When the bolt 114 is extended, the bolt 114 protrudes from the door 102 into a door jamb (not shown) to place the door in a locked state.

The interior assembly 108 can include a manual turnpiece 118 that can be used on the interior side 104 of the door 102 to move the bolt 114 between the extended and retracted positions. The interior assembly 108 can also include a processing unit (not shown) containing electronic circuitry for actuating the latch assembly 112.

Figure 18:
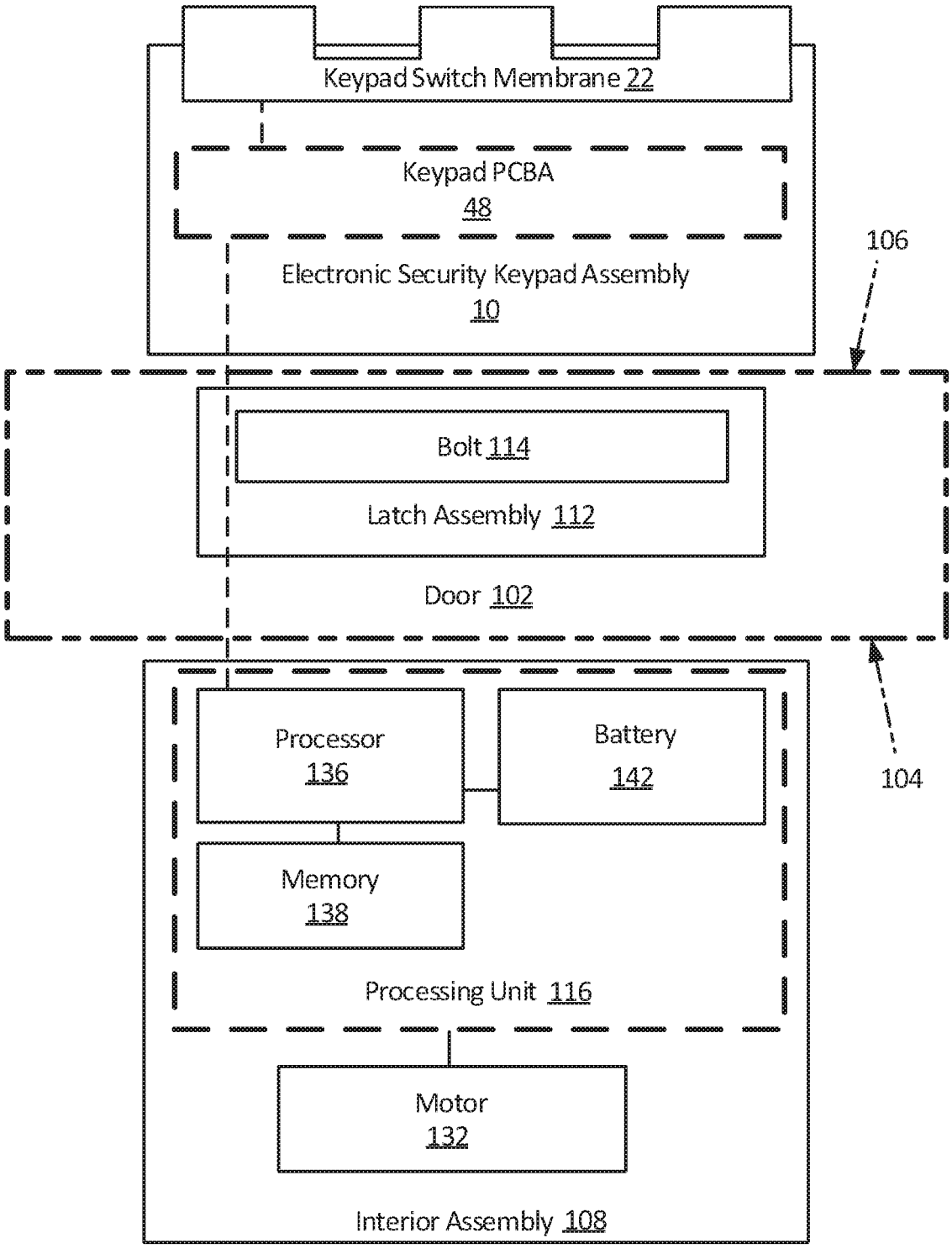
FIG. 18 is a schematic view of a possible electronic lock assembly of FIG. 17.

FIG. 18 is a schematic representation of the electronic security keypad assembly 10 mounted to the door 102. The interior assembly 108 and the latch assembly 112 are also shown.

The electronic security keypad assembly 10 is shown to include the keypad switch membrane 22 and PCBA 48 usable to receive input of security codes.

As described above, the interior assembly 108 includes a processing unit 116. The interior assembly 108 can also include a motor 132.

As shown, the processing unit 116 includes a processor 136 communicatively connected to memory 138 and a battery 142. The processing unit 116 is located within the interior assembly 108 and is capable of operating an electronic lock 100, e.g., by actuating the motor 132 to actuate the bolt 114.

In some examples, the processor 136 can process signals received from the PCBA 48 to determine whether the electronic lock 100 should be actuated. Such processing can be based on a set of preprogramed instructions (i.e., firmware) stored in the memory 138. In some examples, the processing unit 116 is configured to capture a keypad input event from a user and store the keypad input event in the memory 138.

The memory 138 can include any of a variety of memory devices, such as using various types of computer-readable or computer storage media. A computer storage medium or computer-readable medium may be any medium that can contain or store the program for use by or in connection with the instruction execution system, apparatus, or device. By way of example, computer storage media may include dynamic random access memory (DRAM) or variants thereof, solid state memory, read-only memory (ROM), electrically erasable programmable ROM, and other types of devices and/or articles of manufacture that store data. Computer storage media generally includes at least one or more tangible media or devices. Computer storage media can, in some examples, include embodiments including entirely non-transitory components.

The interior assembly 108 also includes the battery 142 to power the electronic lock 100. In one example, the battery 142 may be a standard single-use (disposable) battery. Alternatively, the battery 142 may be rechargeable.

The interior assembly 108 also includes the motor 132 that is capable of actuating the bolt 114. In use, the motor 132 receives an actuation command from the processing unit 116, which causes the motor 132 to actuate the bolt 114 from the locked position to the unlocked position or from the unlocked position to the locked position. In some examples, the motor 132 actuates the bolt 114 to an opposing state. In some examples, the motor 132 receives a specified lock or unlock command, where the motor 132 only actuates the bolt 114 if the bolt 114 is in the correct position. For example, if the door 102 is locked and the motor 132 receives a lock command, then no action is taken. If the door 102 is locked and the motor 132 receives an unlock command, then the motor 132 actuates the bolt 114 to unlock the door 102.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. An electronic security keypad assembly comprising:

a cover comprising a front surface portion having a plurality of openings, at least two side surface portions, and a plurality of fasteners extending therefrom;

a keypad including a plurality of keypad buttons that are configured to be exposed through the plurality of openings in the cover, the plurality of keypad buttons being configured to convert physical input into electrical signals; and a mounting plate comprising a primary surface and a plurality of fastener receiving regions configured to receive the plurality of fasteners, wherein mating the fasteners to the fastener receiving regions comprises bending the fasteners into the fastener receiving regions such that when the fasteners are in a folded position within the fastener receiving regions, the fasteners are positioned in alignment with the primary surface and the keypad is secured between the cover and the mounting plate;

wherein, when the electronic security keypad assembly is installed on a door, the primary surface resides approximately flush with a mounting surface of the door and the plurality of fasteners are positioned between the surface of the door and the mounting plate.

2. The electronic security keypad assembly of claim 1, wherein the cover is formed from sheet metal bent to form the front surface portion and the at least two side surface portions, wherein the at least two side surface portions are at nonlinear angles with the front surface portion.

3. The electronic security keypad assembly of claim 1, further comprising:

a spacer plate placed between the keypad and the mounting plate, the spacer plate configured to provide support to the keypad.

4. The electronic security keypad assembly of claim 1, wherein the keypad comprises a keypad switch membrane, a keypad printed circuit board assembly, and an electrical cable.

5. The electronic security keypad assembly of claim 2, wherein the sheet metal is steel.

6. The electronic security keypad assembly of claim 1, further comprising a pair of 9 volt battery terminals positioned within the keypad assembly such that a portion of the 9 volt battery terminals protrude through one of the plurality of openings in the cover and an insert configured to cover the opening through which the 9 volt battery terminals protrude.

7. The electronic security keypad assembly of claim 1, wherein the at least two side surface portions have a curved surface.

8. The electronic security keypad assembly of claim 2, wherein the cover is formed from a single layer of steel sheet metal.

9. The electronic security keypad assembly of claim 1, wherein the fasteners are tabs and the fastener receiving regions are dented tab receiving regions.

10. The electronic security keypad assembly of claim 9, wherein, when the tabs are in the folded position and residing within the dented tab receiving regions of the mounting plate, the tabs are positioned approximately parallel with the front surface portion of the cover.

11. The electronic security keypad assembly of claim 10, wherein, when the tabs are in the folded position and residing within the dented tab receiving regions of the mounting plate, the tabs do not extend rearwardly of the primary surface of the mounting plate.

12. The electronic security keypad assembly of claim 1, wherein the cover is mated to the mounting plate with a strength lower than the impact force created during vertical impact testing specified by BHMA A156.36 Section 12, such that the cover will be separated from the mounting plate while the mounting plate remains intact.

13. The electronic security keypad assembly of claim 1, wherein the cover further includes top and bottom side surfaces.

14. The electronic security keypad assembly of claim 1, wherein one or more of the at least two side surface portions includes decorative ridges.

15. A method of assembling an electronic security keypad assembly, the method comprising:

providing a cover formed from sheet metal, the cover having a front surface portion having a plurality of openings, at least two side surface portions, and a plurality of tabs extending from the at least two side surface portions;

positioning a keypad between the cover and a mounting plate in alignment with the cover to allow a plurality of keypad buttons of the keypad to be exposed through the plurality of openings in the cover; and bending each of the plurality of tabs into tab receiving regions of the mounting plate until each of the plurality of tabs is positioned in alignment with a rearward surface of the mounting plate;

wherein, when the electronic security keypad assembly is installed on a door, the rearward surface resides approximately flush with a mounting surface of the door and the plurality of tabs are positioned between the surface of the door and the mounting plate.

16. The method of claim 15, wherein the keypad comprises a keypad switch membrane and a printed circuit board assembly.

17. The method of claim 16, further comprising extending an electrical cable from the printed circuit board assembly through the mounting plate.

18. An electronic security keypad assembly mountable to a door, the electronic security keypad assembly comprising:

a cover comprising a front surface portion having a plurality of openings, at least two side surface portions, and a plurality of tabs extending from the at least two side surface portions;

a keypad including a plurality of keypad buttons that are configured to be exposed through the plurality of openings in the cover, the plurality of keypad buttons being configured to convert physical input into electrical signals, the keypad further including a printed circuit board assembly and a cable extending therefrom; and a mounting plate comprising a plurality of dented tab receiving regions that receive the plurality of tabs such that each of the plurality of tabs is bent into a position in alignment with a rearward surface of the mounting plate;

wherein, when the electronic security keypad assembly is installed on a door, the tabs are positioned between a surface of the door and the mounting plate.

* * * * *